US005425530A

United States Patent [19]

Daurte

[11] Patent Number: 5,425,530

[45] Date of Patent: Jun. 20, 1995

[54] AUTOMOTIVE LIFT APPARATUS

[76] Inventor: Paul A. Daurte, 17 South Ave., Tiverton, R.I. 02878

[21] Appl. No.: 167,397

[22] Filed: Dec. 15, 1993

[51] Int. Cl.[6] ..... B66F 7/12

[52] U.S. Cl. ..... 254/89 R

[58] Field of Search ..... 254/7 B, 425, 103, 89 R, 254/92, 45

[56] References Cited

U.S. PATENT DOCUMENTS

| | | | |
|---|---|---|---|
| 34,063 | 1/1862 | Landis | 254/103 |
| 736,564 | 8/1903 | Stollewerk . | |
| 912,198 | 2/1909 | Stafford . | |
| 1,114,829 | 10/1914 | Weaver | 254/7 B |
| 1,211,373 | 1/1917 | Weaver | 254/7 B |
| 1,559,391 | 10/1925 | Waters | 254/7 B |
| 2,152,048 | 3/1939 | Hawkins | 254/425 |
| 2,192,767 | 3/1940 | Courville | 254/425 |
| 2,349,240 | 5/1944 | Aiman . | |
| 2,492,391 | 12/1949 | Minek . | |
| 2,671,636 | 3/1954 | Olson | 254/103 |
| 2,792,913 | 5/1957 | Capgras | 254/45 |
| 3,105,675 | 10/1963 | Blackburn | 254/103 |
| 4,470,284 | 9/1984 | Noé et al. . | |
| 4,515,043 | 5/1985 | Gray . | |

FOREIGN PATENT DOCUMENTS 171812 7/1952 Germany .

*Primary Examiner*—Robert C. Watson

*Attorney, Agent, or Firm*—Samuels, Gauthier & Stevens

[57] ABSTRACT

An apparatus which simultaneously lifting either the front or the rear wheels of a vehicle, including a pair of screw-type jacks, a drive assembly including an input shaft mechanically coupled to a pair of output shafts, each of the output shafts being connected to a respective one of the jacks, whereupon rotation of the input shaft will produce a simultaneous rotation of the output shafts with an accompanying simultaneous actuation of the jacks.

5 Claims, 2 Drawing Sheets

AUTOMOTIVE LIFT APPARATUS

BACKGROUND OF THE INVENTION

1. Field of the Invention

This invention relates generally to screw-type jacks of the type commonly employed to engage and lift vehicle undercarriages, and is concerned in particular with an apparatus for mechanically coupling and simultaneously operating a pair of such jacks in a manner permitting the simultaneous elevation of either the front or rear wheels of a vehicle.

2. Discussion of the Prior Art

It is known to use individual hydraulic or screw-type jacks to lift vehicle undercarriages in order to elevate the wheels, either for maintenance purposes or to accommodate the positioning of jack stands thereunder for prolonged storage. The jacks are conventionally employed singly, first on one side and then the other. As a result, the vehicle is likely to become inclined at some stage during the jacking operation, presenting a danger that it may shift and fall off of the jack or jack stand, possibly injuring those in the vicinity of the vehicle. In addition to being potentially hazardous, the alternative positioning and actuation of single jacks is unduly time consuming with each operation achieving only limited incremental elevations.

SUMMARY OF THE INVENTION

An objective of the present invention is to obviate the above noted problems associated with prior art techniques by providing a drive assembly adapted to be coupled to and to permit simultaneous operation of two screw-type jacks strategically located beneath the vehicle undercarriage. The drive assembly is portable, adapted to be quickly and efficiently connected to the screw-jacks, and operable either manually or by readily available power tools, for example hand held drills and the like.

These and other objects and advantages of the present invention will become more apparent as the description process with the aid of the accompanying drawings, wherein:

DETAILED DESCRIPTION OF THE ILLUSTRATED EMBODIMENT

Figure 1:
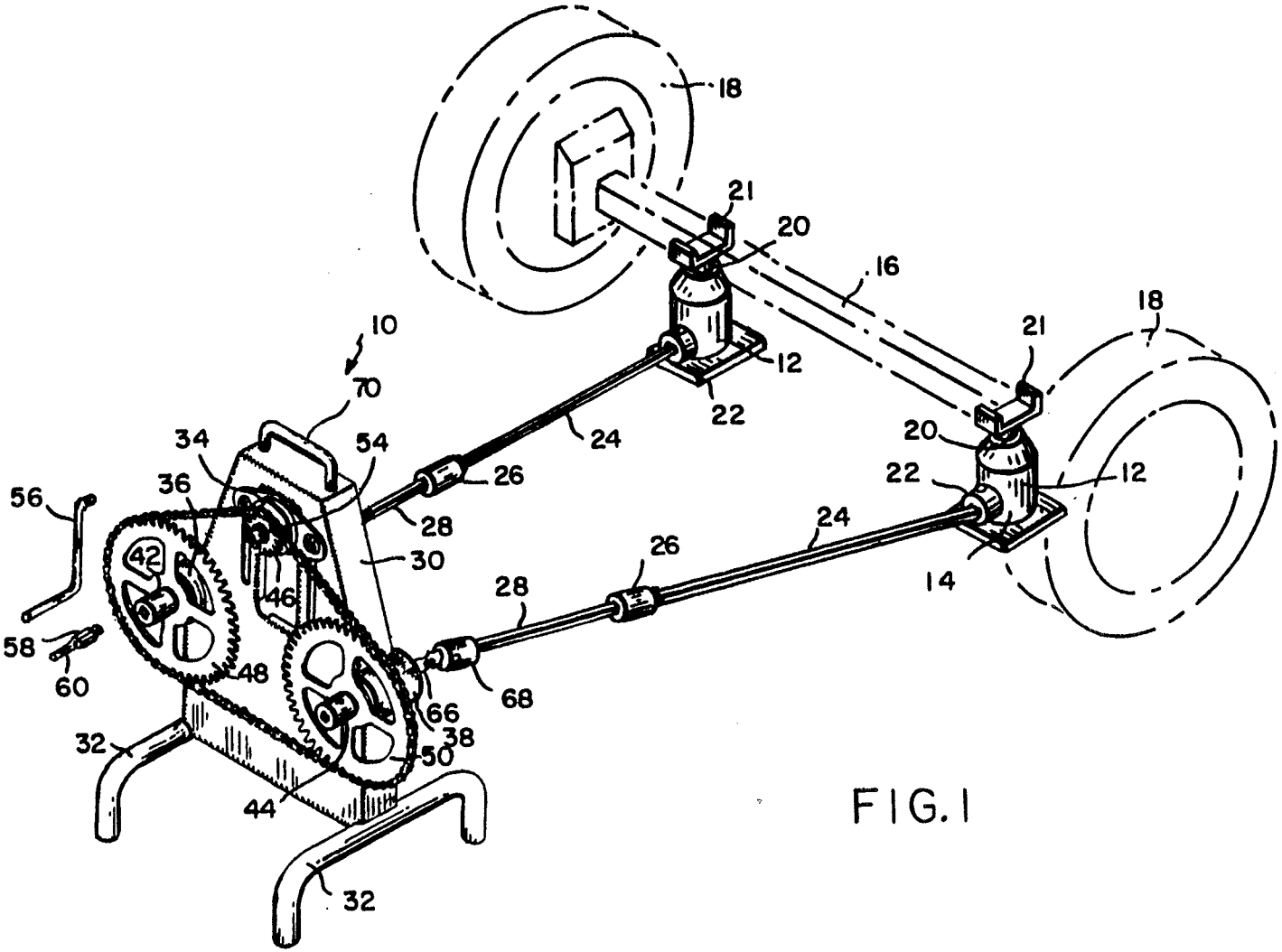
FIG. 1 is a perspective view of a preferred embodiment of the invention shown in conjunction with a phantom illustration of a portion of a vehicle undercarriage.
Figure 2:
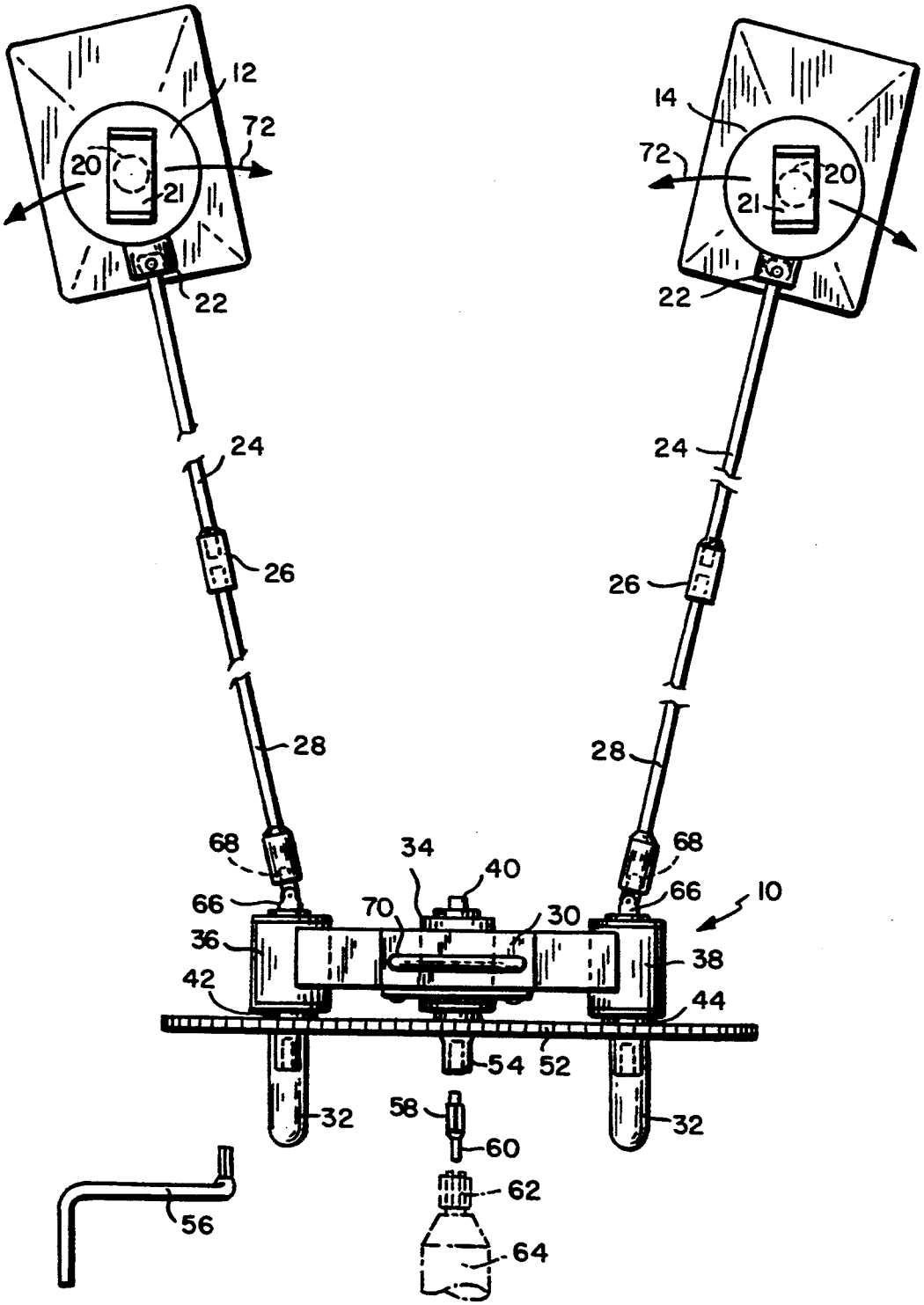
FIG. 2 is a plan view of the components shown in FIG. 1.

Referring now to the drawings, a drive assembly according to a preferred embodiment of the invention is generally indicated at 10. A pair of screw-type jacks 12, 14 is shown positioned beneath a portion 16 of a vehicle undercarriage, each jack being placed adjacent to one of the vehicle wheels 18. The screw jacks are of a conventional type having vertically adjustable screws 20 with rotatable safety brackets 21 at their upper ends. The brackets 21 engage the vehicle undercarriage, and the screws 20 are rotated in either a clockwise or counterclockwise direction by rotation of input collars 22 to which are detachably connected drive rods 24. The drive rods 24 have couplings 26 welded to their ends. Couplings 26 may either be connected directly to the drive assembly 10, or as shown, they may optionally be connected to drive rod extensions 28, thereby enabling the jacks 12, 14 to be strategically positioned beneath the vehicle undercarriage, yet operated remotely from a position adjacent to the vehicle perimeter.

The drive assembly 10 includes an upstanding housing 30 supported on a pair of inverted generally U-shaped legs 32. The housing provides support for three bearing assemblies 34, 36, 38 arranged in a triangular orientation. A drive shaft 40 is journalled for rotation in bearing 34, and driven shafts 42, 44 are journalled for rotation respectively in bearings 36, 38. A drive sprocket 46 is carried on drive shaft 40, and driven sprockets 48, 50 are carried respectively on driven shafts 42, 44. Sprockets 46, 48, 50 are mechanically coupled by means of an endless drive chain 52.

On the front side of the drive assembly, the drive shaft 40 is provided with a female collar 54 which is adapted for engagement by either a conventional crank 56, or by a specially configured drill bit 58 having a conventional shank 60 receivable in the chuck 62 of an electrically powered drill 64.

On the back side of the assembly, each of the driven shafts 42, 44 is provided with a universal joint 66 detachably connected to couplings 68 on the ends of the drive rod extensions 28. The universal joints 66 may also be coupled directly to the couplings 26 on rods 24 in situations where the rod extensions 28 are not required.

It should also be understood that the drill bit 58 is configured to be alternatively engageable with the jack input collars 22 as well as with the couplings 26, thereby facilitating an expedited set up of the jacks in preparation for employment of the drive assembly 10. The crank 56 is also alternatively engageable with either the couplings 68 or the couplings 26 for the same purpose.

The housing 30 includes a carrying handle 70 enabling it to be conveniently transported to and positioned at a location adjacent to the vehicle undercarriage. The universal joints 66 accommodate pivotal adjustment of the jacks 12, 14 as indicated diagrammatically by the arrows 72, thereby enabling the user of the device to strategically position the jacks at the appropriate locations for maximum efficiency during the lifting operation. Once the jacks are positioned, the user need only employ a single tool, for example either the crank 56 or the powered drill 64 operating through the drill bit 58, to rotate the drive shaft 40. Rotation of the drive shaft will operate via the drive and driven sprockets 44, 46, 48 and the drive chain 52 to rotate the driven shafts 42, 44, thereby simultaneously actuating both jacks 12, 14. Simultaneous actuation of the jacks will result in a smooth even lifting of the vehicle undercarriage. Lowering of the vehicle undercarriage can be achieved just as easily by simply rotating the drive shaft 40 in the opposite direction.

In light of the foregoing, it will now be appreciated by those skilled in the art that the present invention provides a novel and improved apparatus for jacking the undercarriages of vehicles in a safe and efficient manner. It should be appreciated that various modifications may be made to the disclosed apparatus without departing from the spirit and scope of the invention. For example, it may be preferable to enclosed the drive chain and the drive and driven sprockets within a protective casing, for example a molded plastic component secured to the housing 30. An accessory tray for conveniently storing the drive rods 24, the drive rod extensions 28, the crank 56 and the drill bit 58 may also be provided, either as an integral part of the molded protective casing, or as a separate component conveniently secured beneath the housing between the support legs 32.

I claim:

1. Apparatus for simultaneously lifting either the front or the rear wheels of a vehicle, comprising:

a pair of screw-type jacks, each jack being adapted for positioning beneath the undercarriage of a vehicle adjacent to one of the wheels to be lifted;

a drive assembly including an input shaft mechanically coupled to a pair of output shafts; and shaft means and associated coupling means for connecting each of said output shafts to a respective one of said jacks, said shaft means and associated coupling means being adapted to accommodate independent positioning of said jacks with respect to each other and with respect to said undercarriage and said drive assembly while said jacks are thus connected, whereupon rotation of said input shaft will produce a simultaneous rotation of said output shafts with an accompanying simultaneous actuation of said jacks, said jacks and said drive assembly being supported independently of said undercarriage, whereupon actuation of said jacks will effect vertical adjustment of said undercarriage with respect to said jacks and said drive assembly.

2. The apparatus as claimed in claim 1 wherein said input shaft is provided with a drive sprocket connected to driven sprockets on said output shafts by a drive chain in intermeshed engagement therewith.

3. The apparatus as claimed in claim 1 wherein said shaft means and associated coupling means further comprises longitudinally extending linkage rods.

4. The apparatus as claimed in claim 3 wherein said linkage rods are connected to said output shafts by universal joints which allow the spacing between said jacks to be varied without interrupting the drive connection between said input shaft and said jacks.

5. Apparatus for simultaneously lifting either the front or the rear wheels of a vehicle, comprising:

a pair of screw-type jacks, each jack being adapted for positioning beneath the undercarriage of a vehicle adjacent to one of the wheels to be lifted;

a drive assembly including an input shaft provided with a drive sprocket connected to driven sprockets on each of two output shafts by a drive chain in intermeshed engagement therewith; and shaft means and associated coupling means including longitudinally extending linkage rods for connecting each of said output shafts to a respective one of said jacks, said shaft means and associated coupling means being adapted to accommodate independent positioning of said jacks with respect to each other and with respect to said undercarriage and said drive assembly while said jacks are thus connected, said linkage rods being connected to said output shafts by universal joints which allow the spacing between said jacks to be varied without interrupting the drive connection between said input shaft and said jacks, whereupon rotation of said input shaft will produce a simultaneous rotation of said output shafts with an accompanying simultaneous actuation of said jacks, said jacks and said drive assembly being supported independently of said undercarriage, whereupon actuation of said jacks will effect vertical adjustment of said undercarriage with respect to said jacks and said drive assembly.

* * * * *

UNITED STATES PATENT AND TRADEMARK OFFICE

CERTIFICATE OF CORRECTION

PATENT NO. : 5,425,530

DATED : June 20, 1995

INVENTOR(S) : Paul A. Duarte

It is certified that error appears in the above-indentified patent and that said Letters Patent is hereby corrected as shown below:

On the title page the name of the inventor should appear as Paul A. Duarte.

Signed and Sealed this

Seventeenth Day of October, 1995

*Attest:*

Bruce Lehman

BRUCE LEHMAN

*Attesting Officer*

*Commissioner of Patents and Trademarks*